United States Patent [19]

Dyer

[11] Patent Number: 4,723,147

[45] Date of Patent: Feb. 2, 1988

[54] APPARATUS FOR DRYING A WEB OF SHEET MATERIAL HAVING A FUSED IMAGE THEREON

[75] Inventor: Dexter A. Dyer, Williamson, N.Y.

[73] Assignee: Xerox Corporation, Stamford, Conn.

[21] Appl. No.: 891,034

[22] Filed: Jul. 31, 1986

[51] Int. Cl.[4] ..... G03G 15/10

[52] U.S. Cl. ..... 355/10; 354/316; 355/3 R

[58] Field of Search ..... 355/3 R, 10; 354/300, 354/316, 320, 322

[56] References Cited

U.S. PATENT DOCUMENTS

| | | | |
|---|---|---|---|
| 2,102,843 | 12/1937 | Gwynne | 354/320 X |
| 2,842,865 | 7/1958 | Enkelmann | 354/300 X |
| 2,928,329 | 3/1960 | Limbach | 354/322 X |
| 2,972,196 | 2/1961 | Early et al. | 34/1 |
| 3,794,417 | 2/1974 | Machmer | 355/3 |
| 3,854,224 | 12/1974 | Yamaji et al. | 355/10 X |
| 3,965,332 | 6/1976 | Thettu | 219/216 |
| 4,121,888 | 10/1978 | Tomura et al. | 355/14 |
| 4,259,006 | 3/1981 | Phillips et al. | 355/10 |
| 4,462,675 | 7/1984 | Moraw et al. | 355/10 X |

*Primary Examiner*—Fred L. Braun

*Attorney, Agent, or Firm*—H. Fleischer; J. E. Beck; R. Zibelli

[57] ABSTRACT

A reproducing machine in which a latent image recorded on a member is developed with a liquid developer material including at least a liquid carrier having pigmented particles dispersed therein. The developed image is transferred from the member to a portion of a moving web of sheet material. The pigmented particles are fused to the web of sheet material in image configuration. A flow of heated air is directed over an extended region of the web of sheet material in a direction parallel to the direction of the movement of the web and in a direction opposed to the direction of movement of the web to vaporize liquid carrier therefrom so as dry the web of sheet material.

4 Claims, 1 Drawing Figure

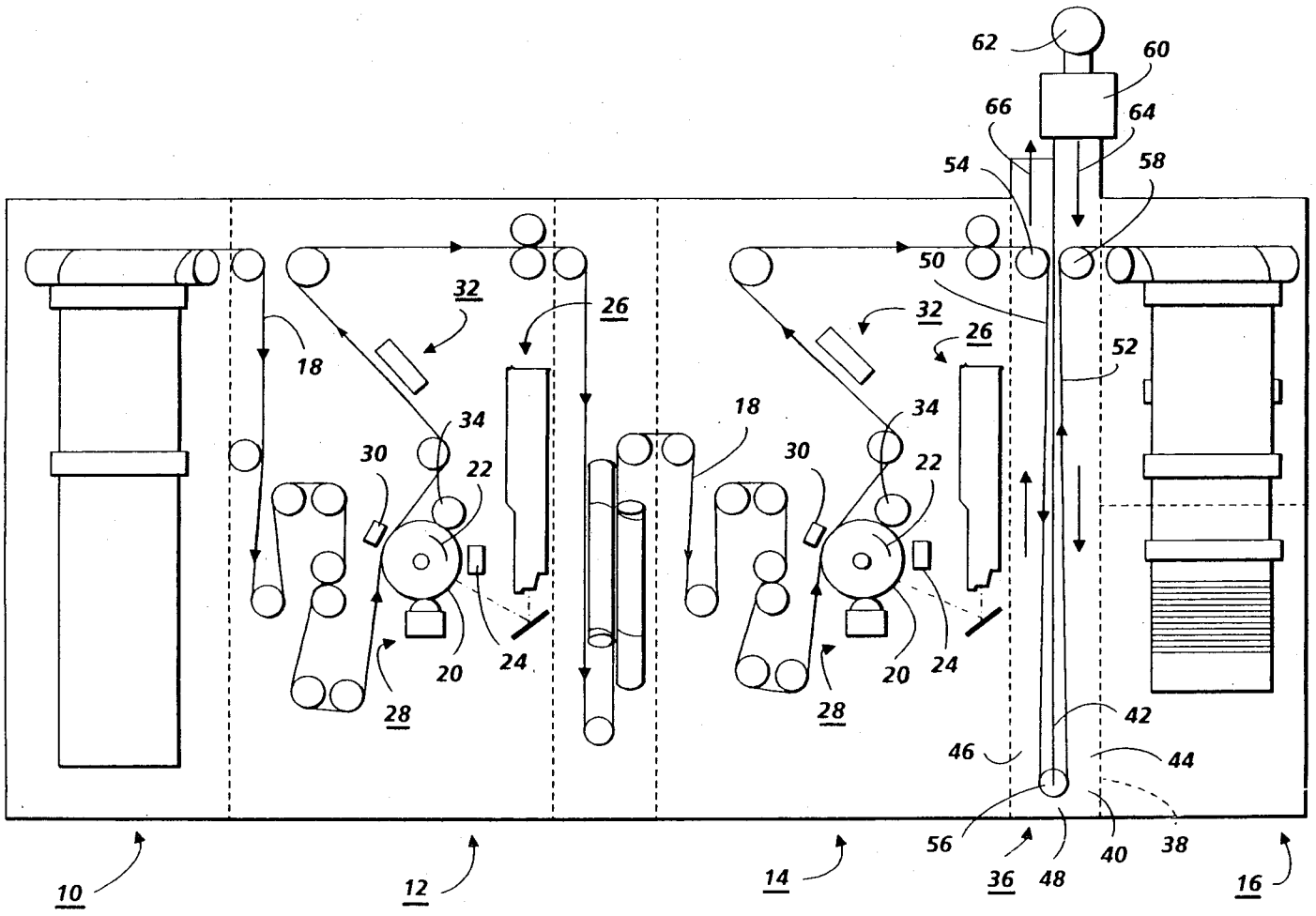
10
12
14
16
18
20
22
24
26
28
30
32
34
36
38
40
42
44
46
48
50
52
54
56
58
60
62
64
66

APPARATUS FOR DRYING A WEB OF SHEET MATERIAL HAVING A FUSED IMAGE THEREON

This invention relates generally to an electrophotographic printing machine, and more particularly concerns drying a moving web of sheet material wetted with liquid carrier.

Generally, the process of electrophotographic printing inlcudes charging a photoconductive member to a substantially uniform potential to sensitize the surface thereof. The charged portion of the photoconductive member is exposed to a light image of an original document being reproduced. This records an electrostatic latent image on the photoconductive member corresponding to the informational areas contained within the original document. After the electrostatic latent image is recorded on the photoconductive member, the latent image is developed by bringing a liquid developer material into contact therewith. The liquid developer material comprises a liquid carrier having pigmented particles therein. The pigmented particles are deposited, in image configuration, on the photoconductive member. Thereafter, the developed image is transferred to the copy sheet. Invariably, some of the liquid carrier is transferred along with the pigmented particles to the copy sheet. After transfer, heat is supplied to the copy sheet to permanently fuse the pigmented particles thereto and to vaporize the residual liquid carrier.

Numerous techniques have been devised for fusing the pigmented particles to the copy sheet and vaporizing the residual liquid carrier therefrom. Among these are oven fusing, hot air fusing, flash fusing and roll fusing. In high speed electrophotographic printing machines, webs of sheet material rather than cut sheet are employed. Thus, it is necessary to drive off the liquid carrier from the web of sheet material which is moving at a relatively high speed. Furthermore, the air surrounding the web of sheet material should contain liquid carrier vapors at a level no greater than 25% of the lower explosion limit of the liquid carrier. Thus, it is desirable to minimize the temperature required to dry the web of sheet material. It is clearly desirable to fuse the pigmented particles to the web of sheet material independently of drying the web of sheet material. In this manner, the drying operation can be achieved at a lower temperature. This requires less energy and is more efficient. Hence, it is advantageous to be capable of drying the web of sheet material at some lower intermediate temperature rather than at the fusing temperature and maintaining the air saturated with liquid carrier vapor at or below 25% of the lower explosion limit of the vaporized liquid carrier. Hereinbefore, various techniques have been devised for improving fusing and drying cut sheets and webs of sheet material. The following disclosures appear to be relevant: U.S. Pat. No. 2,972,196 to patentee: Early et al., issued: Feb. 21, 1961; U.S. Pat. No. 3,794,417 to patentee: Machmer, issued: Feb. 26, 1974; U.S. Pat. No. 3,965,332 to patentee: Thettu, issued: June 22, 1976; U.S. Pat. No. 4,121,888 to patentee: Tomura et al. issued: Oct. 24, 1978; U.S. Pat. No. 4,259,006 to patentee: Phillips et al., issued: Mar. 31, 1981.

The relevant portions of the foregoing patent may be briefly summarized as follows:

Early et al. discloses a method of drying printed webs in which an electric arc plasma is brought into contact with the coated surface thereof. The intense heat of plasma causes instantaneous evaporaton of the solvent in the ink coating. The arc plasma is produced by applying a high voltage across a pair of electrodes slightly spaced above the surface of the printed web. The volatized material given off by the ink is exhausted from the space around the arc by passing a current of air over the arc, or by any other suitable means.

Machmer discloses an internally heated roll fuser for fusing plastic powder images to a sheet of support material.

Thettu discloses a fusing apparatus in which a copy sheet passes through a nip defined by a fuser roller and a pressure roller. A radiant heater is employed to prefix the toner powder image to the copy sheet. The fuser roller and its associate back-up roller thereafter, fix the toner image permanently to the copy sheet.

Tomura et al. discloses a fixing unit employing a radiant heat source throughout its length. The toner images are initially heated by hot plates, followed by exposure to a decreased optical output of a flash lamp.

Phillips et al. describes an air jet which drives spent dispersant on the photoconductive drum back onto a metering roller which returns the dispersant to a reservoir. The heat required to fuse the image to the copy sheet is minimized by the removal of the excessive developed material.

In accordance with one aspect of the present invention, there is provided a reproducing machine of the type having a latent image recorded on a member. Means are provided for developing the latent image recorded on the member with liquid developer material comprising at least a liquid carrier having pigmented particles dispersed therein. Means transfer the developed image from the member to a portion of a moving web of sheet material. Means fuse the pigmented particles to the web of sheet material in image configuration. Means direct a flow of heated air over an extended region of the web of sheet material in a direction parallel to the direction of movement of the web and in a direction opposed to the movement of the web to vaporize liquid carrier therefrom so as to dry the web of sheet material.

Pursuant to another aspect of the features of the present invention, there is provided an electrophotographic printing machine of the type having an electrostatic latent image recorded on a photoconductive member. Means develop the latent image recorded on the photoconductive member with a liquid developer material comprising at least a liquid carrier having pigmented particles dispersed therein. Means transfer the developed image from the photoconductive member to a portion of a moving web of sheet material. Means fuse the pigmented particles to the web of sheet material in image configuration. Means are provided for directing a flow of heated air over an extended region of the web of sheet material in a direction parallel to the direction of movement of the web and in a direction opposed to the movement of the web to vaporize liquid carrier therefrom so as to dry the web of sheet material.

Other aspects of the present invention will become apparent as the following description proceeds and upon reference to the drawing which depicts a schematic elevational view of an illustrative electrophotographic printing machine incorporating the dryer of the present invention therein.

While the present invention will hereinafter be described in conjunction with a preferred embodiment thereof, it will be understood that it is not intended to limit the invention to this embodiment. On the contrary, it is intended to cover all alternatives, modifications, and equivalents as may be included within the spirit and scope of the invention as defined by the appended claims.

Inasmuch as the art of electrophotographic printing is well known, the various processing stations employed in the printing machine will be shown hereinafter with reference to the drawing and their operation described briefly.

As shown in the drawing, the electrophotographic printing machine is divided into four modules. Module 10 is a web supply module. Modules 12 and 14 are printing modules and module 16 is a sheet cutter and stacker module. In module 10, a web of sheet material 18 is advanced from a roller thereof to printer modular 12. Printer module 12 employs a drum 20 having a photoconductive surface deposited on an electrically grounded conductive substrate. Preferably, the photoconductive surface is made from a selenium alloy with the conductive substrate being made from an electrically grounded aluminum alloy. Drum 20 rotates in the direction of arrow 22 to advance successive portions of the photoconductive surface through the various processing stations disposed about the path of movement thereof. Initially, a portion of drum 20 passes through a charging station where a corona generating device, indicated generally by the reference numeral 24, charges the photoconductive surface of drum 20 to a relatively high, substantially uniform potential. Next, the charged portion of the photoconductive surface is advanced through the imaging station. At the imaging station, a laser system, indicated generally by the reference numeral 26, projects a modulated laser beam onto the charged portion of the photoconductive surface of drum 20 to selectively dissipate the charge thereon. This records an electrostatic latent image on the photoconductive surface. While a laser system has been described, one skilled in the art will appreciate that other techniques, such as light lens system and an opaque original document may also be employed to selectively discharge the charged portion of the photoconductive surface to record the electrostatic latent image thereon. After imaging, drum 20 rotates the electrostatic latent image recorded on the photoconductive surface to the development station. At the development station, a developer unit, indicated generally by the reference numeral 28, includes a roller adapted to advance a liquid developer material into contact with the electrostatic latent image on the photoconductive surface of drum 20. By way of example, the liquid developer material may comprise an insulating liquid carrier material, made from an aliphatic hydrocarbon, largely decane, which is manufactured by the Exxon Corporation under the trademark Isopar, having toner particles dispersed therein. Preferably, the toner particles are made predominantly from a pigmented particle such as suitable resin, i.e. carbon black. A suitable liquid developer material is described in U.S. Pat. No. 4,582,774 issued to Landa in 1986, the relevant portions thereof being hereby incorporated into the present application. The developed electrostatic latent image is transported on drum 10 to the transfer station. At the transfer station, the web of sheet material 18 contacts drum 20 in synchronism with the developed electrostatic latent image. A corona generating device 30 sprays ions onto the back side of the web of sheet material to attract the liquid developed image thereto. After transfer, the web of sheet material continues to move so as to advance the liquid image thereon to the fusing station. The fusing station includes a fuser assembly, indicated generally by the reference numeral 32, which permanently fuses the toner particles to the web of sheet material in image configuration. However, at this time the web of sheet material is still wet with liquid carrier. Preferably, fuser assembly 32 is a radiant heater which generates radiant energy in the infrared wave length which is selectively absorbed by the toner particles on the web of sheet material. This causes the toner particles to melt and fuse to the copy sheet. By way of example, the radiant heater incudes an infrared quartz lamp which is mounted in a reflector assembly in opposing relation to the web of sheet material and in a position to thermally communicate with the image side thereof. However, one skilled in the art will appreciate that any suitable radiant heater may be employed to fuse the toner particles to the copy sheet. Furthermore, one skilled in the art will appreciate that an oven heater or flash fuser may be employed in lieu of a radiant heater to fuse the toner particles to the web of sheet material. Invariably, some residual liquid carrier remains adhering to the photoconductive surface of drum 20. This residual material is removed from the photoconductive surface at the cleaning station. The cleaning station includes a cleaning roller 34, formed of any appropriate synthetic resin driven in a direction opposite to the direction of movement of the photoconductive surface to scrub the photoconductive surface clean. To assist in this cleaning action, developing liquid may be fed onto the surface of cleaning roller 34. A wiper blade may be employed to complete the cleaning of the photoconductive surface. Any residual charge left on the photoconductive surface is discharged by flooding the photoconductive surface with light from a lamp.

As shown in the drawing, the web of sheet material 18 may also advance through printer module 14. Printer module 14 is substantially identical to printer module 12 and also forms a fused toner image on the web of sheet material. The web of sheet material from either printer module 12 or printer module 14 advances into a drying unit, indicated generally by the reference numeral 36, which is located prior to the sheet cutting and stacking module 16. At drying unit 36, the liquid carrier is vaporized by a flow of hot air passing over the web of sheet material. Thereafter, the web of sheet material advances to sheet cutting and stacking module 16 wherein the web of sheet material is cut into discrete sheets and stacked.

With continued reference to the drawing, drying unit 36 will be described hereinafter in greater detail. As shown thereat, drying unit 36 includes a housing 38 having a chamber 40 therein. Chamber 40 has partition 42 which extends from the upper surface of the housing downwardly to the lower portion thereof, being spaced from the lower wall of the housing. In this way, chamber 40 is divided into two sections, 44 and 46, which are in communication with one another in lower region 48. The web of sheet material 18 moves downwardly in the direction of arrow 50 in section 46 and upwardly in the direction of arrow 52 in section 44. Roller 54 guides the web of sheet material 18 in section 46 around roller 56 which is secured rotatably to the lower end of partition 42. The web of sheet material is guided around roller 56 into section 44 and around roller 58 to exit drying unit 36. The distance between roller 56 and rollers 54 and 58 is approximately six feet. In this way, the web of sheet material advances through a twelve foot area in drying unit 36. Section 44 is connected to a heat exchanger 60. Heat exchanger 60 is, in turn, connected to blower 62. Blower 62 directs a flow of air through heat exchanger 60. The air emitted from heat exchanger 60 is at a temperature ranging from about 100° F. to about 150° F. and moves in the direction of arrow 64 in section 44. Thus, the heated air in section 44 is moving in an opposite direction to the direction of movement of web 18. The heated air in section 44 moves downwardly to the lower region of housing 38 and moves through the gap 48 between partition 42 and the lowermost wall of housing 38 into section 46. In section 46, the heated air moves in the direction of arrow 66 to exit from drying unit 36. In this way, approximately twelve feet of the web of sheet material is exposed to heated air. Thus, the web of sheet material with the liquid carrier thereon passes through an elongated drying unit. The heated air vaporizes the liquid carrier from the web of sheet material to dry the web. The air flow maintains the stream of air and vaporized liquid carrier at or below 25% of the lower explosion limit of the vaporized liquid carrier. Air exiting from drying unit 36 may be subsequently processed in a solvent recovery unit where the vaporized liquid carrier is condensed and recycled for subsequent use in the respective developing units.

In recapitulation, it is clear that the drying apparatus of the present provides an elongated path for a web of sheet material having a portion thereof wetted with liquid carrier. Heated air moves in a direction opposite to the direction of movement of the web of sheet material so as to vaporize the liquid carrier therefrom and dry the web of sheet material.

It is, therefore, evident that there has been provided in accordance with the present invention, an apparatus that fully satisfies the aims and advantages heretofore mentioned. While this invention has been described in conjunction with a preferred embodiment thereof, it is evident that many alternatives, modifications and variations will be apparent to those skilled in the art. Accordingly, it is intended to embrace all such alternatives, modifications and variations that fall within the spirit and broad scope of the appended claims.

I claim:

1. An electrophotographic printing machine of the type having an electrostatic latent image recorded on a photoconductive member, including:

means for developing the latent image recorded on the photoconductive member with a liquid developer material comprising at least a liquid carrier having pigmented particles dispersed therein;

means for transferring the developed image from the photoconductive member to a portion of a moving web of sheet material;

means for fusing the pigmented particles to the web of sheet material in image configuration;

an elongated housing defining a chamber partitioned partially in two halves with the web of sheet of support material moving in one direction in one half thereof and moving in the opposite direction in the other half thereof; and means for generating a flow of heated air along the web of sheet material in one half of the chamber of said housing in a direction opposed to the direction of movement of the web of sheet material and in the same direction as the direction of movement of the web of sheet material in the other half of the chamber of said housing to vaporize liquid carrier therefrom so as to dry the web of sheet material.

2. A printing machine according to claim 1, wherein said fusing means includes a radiant heater arranged to radiate sufficient energy onto the web of sheet material to fuse the pigmented particles thereto in image configuration.

3. A printing machine according to claim 2, wherein said directing means furnishes a flow of heated air to one half of the chamber of said housing and exhausts heated air from the other half of the chamber of said housing.

4. A printing machine according to claim 3, wherein said directing means furnishes air heated to a temperature ranging from about 100° F. to about 150° F.

* * * * *